United States Patent [19]

Takahashi

[11] Patent Number: 4,619,891

[45] Date of Patent: Oct. 28, 1986

[54] PHOTOSENSITIVE MATERIAL WITH PARTICLES OF HYDROQUINONE AND POLYMER

[75] Inventor: Osamu Takahashi, Kanagawa, Japan

[73] Assignee: Fuji Photo Film Co., Ltd., Kanagawa, Japan

[21] Appl. No.: 732,769

[22] Filed: May 10, 1985

[30] Foreign Application Priority Data

May 11, 1984 [JP] Japan ..... 59-95269

[51] Int. Cl.[4] ..... G03C 1/40; G03C 5/54

[52] U.S. Cl. ..... 430/505; 430/214; 430/215; 430/217; 430/218; 430/536; 430/537

[58] Field of Search ..... 430/214, 215, 217, 218, 430/505, 536, 537

[56] References Cited

U.S. PATENT DOCUMENTS

| | | | |
|---|---|---|---|
| 4,201,578 | 5/1980 | Abbott | 430/218 |
| 4,366,236 | 12/1982 | Takahashi | 430/214 |
| 4,575,481 | 3/1986 | Takahashi | 430/214 |
| 4,584,263 | 4/1986 | Takahashi | 430/214 |

OTHER PUBLICATIONS

"Photographic Processes and Products", *Research Disclosure*, No. 15162, 11/1976, pp. 75–87.

*Primary Examiner*—Richard L. Schilling

*Attorney, Agent, or Firm*—Sughrue, Mion, Zinn, Macpeak, and Seas

[57] ABSTRACT

A photosensitive material having a widened temperature lattitude. The photosensitive material is described, comprising a support having thereon at least one silver halide emulsion layer associated with a dye-providing compound capable of forming an imagewise mobile dye as the result of exposure and development, wherein a hydroquinone derivative and a water-insoluble but organic solvent-soluble homopolymer or copolymer having a recurring unit containing a

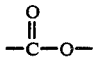

bond in the main chain or side chain are integrated and dispersed as individual particles in a hydrophilic colloid of the silver halide emulsion layer or layers or the dye providing compound containing layer or layers.

8 Claims, No Drawings

PHOTOSENSITIVE MATERIAL WITH PARTICLES OF HYDROQUINONE AND POLYMER

FIELD OF THE INVENTION

The present invention relates to photosensitive materials, and more particularly to color photosensitive materials. More specifically, the present invention relates to color diffusion transfer process type photosensitive materials which have improved processing temperature latitude of any optional silver halide emulsion layer or layers.

BACKGROUND OF THE INVENTION

In the field of color diffusion transfer process type photosensitive materials, there have been various well-known integrated color diffusion transfer systems. For example, the color diffusion transfer systems are disclosed in U.S. Pat. Nos. 3,415,644, 3,415,645, 3,415,646, 3,467,437, 3,635,707 and 3,756,815, and as well, Canadian Pat. Nos. 928,559 and 674,082. The other kind of color diffusion transfer systems, that is, so-called "Peel-Apart" systems are disclosed in, for example, U.S. Pat. Nos. 2,983,606, 3,362,319 and 3,362,821.

In such diffusion transfer systems, development is not always conducted at a fixed optimum temperature, but it has been desirable to obtain a predetermined photographic property, usually in a certain termperature range of, for example, about 10° to about 35° C.

Comparing the development at a high temperature with that at a low temperature, the development is accelerated at a high temperature and a large amount of dyes are released. As a result, a remarkable decrease in sensitivity and as well an increase in maximum density ($D_{max}$) are brought about.

Heretofore, for example, techniques for solving the above-mentioned problem have been proposed. For example, Japanese Patent Application (OPI) No. 74744/79 states that hydroquinone-ester derivatives, which are a precursor of mobile hydroquinones, are mounted on a timing layer or a layer in the rear of the timing layer in the direction in which processing solution is developed, and mobile hydroquinones which are competitive developing agents are diffused into a light-sensitive layer at a high temperature so that the competitive developing agents develop silver but do not cause dyes to release, whereby the problem of "the decrease in sensitivity and as well the increase of $D_{max}$ at a high temperature" can be eliminated. However, in the case of using the mobile hydroquinones, usually the following problems have arisen: 1) Since the hydroquinones themselves or the decomposed products thereof are diffused into a mordant layer, stains comes about, resulting in the image quality being remarkably degraded; and 2) no method is obtainable for independently controlling any optional layer or layers among a blue-sensitive layer (B layer), a green-sensitive layer (G layer) and a red-sensitive layer (R layer). For example, estimating that magenta alone is intended to be adjusted without changing yellow and cyan in the case of multi-color photograph, yellow and cyan are also inevitably changed (it is because the mobile hydroquinones which are diffusible affect all of the light-sensitive layers, that is, all of B, G and R layers).

*Research Disclosure,* Vol. 152, No. 15235, (December, 1976), describes an improvement in processing temperature lattitude by the combination of specified scavengers, that is, didodecyl hydroquinone and 4-amino-1-hydroxy-N-[α-2, 4-di-t-aminophenoxibutyl]-2-naphtoamido. However, the above-mentioned combination of such peculiar scavengers has brought about the following disadvantages: (1) the degree of freedom of activity adjustment is low since the activity of scavengers are inevitably determined by the chemical constitution of the specified scavengers used; (2) control of the processing temperature latitude cannot be made to any optional layer or layers of R, G and B layers independently; (3) the improvement in processing temperature latitude is not great, etc.

SUMMARY OF THE INVENTION

An object of the present invention is to provide photosensitive materials which have improvided the processing temperature latitude of any optional silver halide emulsion layer or layers.

Other and further objects, features and advantages of the present invention will appear more fully from the following description.

The above-mentioned objects of the present invention can be achieved by a photosensitive material comprising a support having thereon at least one silver halide emulsion layer associated with a dye-providing compound capable of forming an imagewise mobile dye as the result of exposure and development, wherein a hydroquinone derivative and a water-insoluble but organic solvent-soluble homopolymer or copolymer having a recurring with containing a

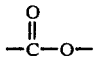

bond in the main chain or side chain are integrated and dispersed as individual particles in a hydrophilic colloid of the silver halide emulsion layer or layers or the dye providing compound containing layer or layers.

DETAILED DESCRIPTION OF THE INVENTION

The term of improved processing temperature latitude referred to in this application means that the difference of the image density, particularly in the gradation density area, has been minimized between high and low processing temperature.

Here, it is noted that the term "imagewise" includes, so-called "inversely imagewise" in accordance with a kind of used silver halide.

The used hydroquinone derivatives are preferably hydroquinone derivative mixtures having a solidifying point less than 100° C.

It is noted here that the "solidifying point of a hydroquinone derivative mixture" corresponds to the eutectic point of mixtures having an eutectic point (eutectic mixture), or the temperature at which mixtures having no eutectic point initiate to solidify. Further, the "hydroquinone derivative mixture" means that is a mixture including at least two kinds of hydroquinone derivatives.

The mechanism of improving the processing temperature latitude by the photosensitive materials according to the present invention has not yet precisely determined. However, it is clear that the activation in reaction of hydroquinone derivatives with an oxidation product of developing agent is affected in the dispersed individual particles by the polymer such as, for example, the abovementioned homopolymer or copolymer which coexists with the hydroquinone derivatives. Further, the cause of the affection can be estimated such that the hydroquinone derivatives and the polymer have a certain interaction which becomes strong at a low temperature (accordingly, the hydroquinone is firmly protected by the polymer), but weak at a high temperature (accordingly, the condition that the hydroquinones alone exist is nearly established). That is, the hydroquinone derivatives compete with the dye providing compounds, and since the degree of activation in reaction of the hydroquinone derivatives with the oxidation product of developing agent becomes weak at a low temperature but strong at a high temperature, the hydroquinone derivatives effectively react with excessive oxidation product of developing agent at a high temperature to nullify the oxidation product. As a result, the processing temperature dependency of the transferred dye density corresponding to the layer or layers into which the individual particles according to the present invention are added can be restrained. That is, the processing temperature latitude can be enlarged. Further, the photosensitive material according to the present invention is excellent due to that it allows the activation of hydroquinone derivatives to be continuously adjusted over a wide range by controlling the kinds of polymers and the amount thereof with respect to hydroquinone derivatives.

Furthermore, U.S. Pat. No. 4,366,236 (which corresponds to Japanese Patent Application (OPI) No. 1257385/81) discloses color diffusion transfer process type photosensitive materials in which hydroquinone derivatives and the above-mentioned polymer are integrated and dispersed as individual particles in so-called the "intermediate layer which is other than a silver halide emulsion layer or a dye providing compound containing layer". However, in the case that the abovementioned particles are dispersed in the intermediate layer, there is offered such a problem that the gradations of R, G and B layers in the photographic characteristic curves are not harmonious, particularly in the toe parts of the characteristic curves, or even in one layer the gradation in the toe part of the characteristic curve varies with variations in the processing temperature. On the contrary, the present invention offers such an advantage that the gradations in the toe parts can be optionally harmonized.

Homopolymers and copolymers disclosed in the abovementioned U.S. Pat. No. 4,366,236 can be referred to as examples of the water-insoluble but organic solvent-soluble homopolymers or copolymers having a recurring unit containing a

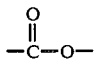

bond in the main chains and side chains, which can be used in the present invention.

Typical examples of the polymers used in the present invention are shown below although the polymers used in the present invention are not limited to those materials.

(A) Homopolymers and copolymers each having the recurring unit shown by the following formula

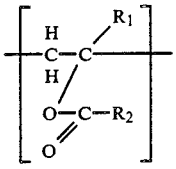

wherein $R_1$ represents hydrogen atom or an alkyl group (including a substituted alkyl group) and $R_2$ represents an alkyl group (including a substituted alkyl group) or an aryl group (including a substituted aryl group).

As the substituent of the substituted alkyl groups shown by $R_1$ and $R_2$, there are halogen atom, an alkoxy group, an aryl group, an acyl group, a cyano group, an amino group, etc. Also, as the substituent of the substituted aryl groups shown by $R_2$, there are an alkyl group, a halogen atom, an alkoxy group, etc. The preferred example of the alkyl group shown by $R_1$ is a methyl group.

These polymers are prepared using proper vinyl monomers and examples of these vinyl monomers are vinyl acetate, vinyl propionate, vinyl butyrate, vinyl isobutyrate, vinyl caproate, vinyl chloroacetate, vinyl methoxyacetate, vinyl phenylacetate, vinyl acetoacetate, vinyl lactate, vinyl benzoate, vinyl chlorobenzoate, vinyl naphthonate, etc.

Examples of proper comonomers which can be copolimerized with the above-described monomers are acrylonitrile, methacrylonitrile, styrene, α-methylstyrene, vinyl chloride, vinylidene, chloride, methyl vinyl ketone, fumaric acid ester, maleic acid ester, itaconic acid ester, α-chloroethylvinyl ether, methylenemalonitrile, acrylic acid, methacrylic acid, dimethylaminoethyl methacrylate, butadiene, isoprene, vinylidene, etc.

Practical examples of the aforesaid homopolymer and copolymer are as follows:

(1) polyvinyl acetate (2) polyvinyl propionate (3) vinyl acetate-vinyl alcohol copolymer (90:10)

(B) Homopolymers and copolymers each having the recurring unit shown by the following formula

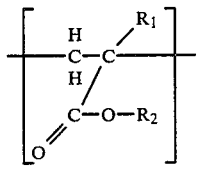

wherein $R_1$ and $R_2$ have the same significance as described in (A).

Examples of proper vinyl monomers used for preparing these polymers are methyl acrylate, ethyl acrylate, n-propyl acrylate, isopropyl acrylate, n-butyl acrylate, octyl actylate, 2-chloroethyl acrylate, 2-cyanoethyl acrylate, N-(β-dimethylaminoethyl) acrylate, benzyl acrylate, cyclohexyl acrylate, phenyl acrylate, methyl methacrylate, ethyl methacrylate, n-propyl methacrylate, isopropyl methacrylate, n-butyl methacrylate, octyl methacrylate, cyclohexyl methacrylate, benzyl methacrylate, etc. Examples of proper comonomers which can be copolymerized with these monomers are the vinyl monomers illustrated in (A).

Practical examples of the homopolymers and copolymers are as follows:

(4) polymethyl methacrylate
(5) polyethyl acrylate
(6) polyethyl methacrylate
(7) polybutyl acrylate
(8) polybutyl methacrylate
(9) polyisobutyl methactylate
(10) polyisopropyl methacrylate
(11) polyoctyl acrylate
(12) butyl acrylate-acrylamide copolymer (95:5)
(13) stearyl methacrylate-acrylic acid copolymer (90:10)

(C) Polyester resins obtained by the condensation of polyhydric alcohols and polybasic acids.

Examples of the effective polyhydric alcohols are the glycols having the structure HO—$R^3$—OH (wherein $R^3$ represents a hydrocarbon chain, in particular, an aliphatic hydrocarbon chain of 2 to about 12 carbon atoms) and polyalkylene glycols and examples of the effective polybasic acids are those having the structure HOOC—$(R^4)_p$—COOH (wherein p is 0 or 1 and when p is 1, $R^4$ represents a hydrocarbon chain of 1 to about 12 carbon atoms).

Practical examples of the polyhydric alcohols are ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,4-pentanediol, glycerol, diglycerol, triglycerol, 1-methylglycerol, erithrite, mannitol, sorbitol, etc.

Practical examples of the polybasic acids are oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophathalic acid, metaconic acid, isopimelic acid, cyclopentadienemaleic anhydride adduct, rosin-maleic anhydride adduct, etc.

Practical examples of the polyester resin are as follows:

(14) 1,4-butanediol-adipic acid polyester
(15) ethylene glycol-sebacic acid polyester (D) Others;

For example, the polyesters obtained by the following ring opening-polymerization:

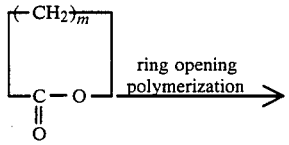

polyester having the following recurring unit

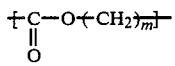

wherein m represents an integer of 4 to 7 and the chain —$CH_2$— may be a branched one.

Proper monomers used for preparing these polyesters and β-propiolactone, γ-caprolactone, dimethylpropiolactone, etc.

Practical examples of the polyesters are as follows:

(16) polycaprolactone
(17) polypropiolactone
(18) polydimethylpropiolactone

Further, more than two kinds of polymers as mentioned above can be combinedly used. In addition, the third component such as high boiling point solvents, etc. can also be combinedly used. Suitable examples of the high boiling point solvents include an aliphatic acid ester (for example, triglyceride of higher aliphatic acid, dioctyladipate, etc.), a phthalic acid ester (for example, di-n-butyl phthalate, etc.), a phosphoric acid ester (for example, tri-o-cresyl phosphate, tri-n-hexyl phosphate, an amide (for example, N,N-diethyllauramide), a hydroxy compound (for example, 2,4-di-n-amylphenol), etc.

Preferred examples of hydroquinone derivatives which are effectively used in the present invention include nondiffusible type hydroquinones. As specific example of the above-mentioned hydroquinone derivatives, it can be referred to *Research Disclosure,* Vol. 151, No. 15162, (November, 1976) and the above-mentioned U.S. Pat. No. 4,366,236 both of which disclose nondiffusible type hydroquinone derivatives as compounds used in the intermediate layer. Particularly, they are preferably isomer mixtures representative of which are the mixture of hydroquinone compounds wherein two tertiary alkyl groups having 15 carbon atoms are substituted at 2- and 5-positions, or 2- and 6-positions of the benzene ring, and the isomer mixture of secondary dodecyl hydroquinone compounds.

According to the present invention, a preferable process for preparing the dispersion of individual particles wherein hydroquinone derivatives and a polymer are integrated includes such steps that the hydroquinone derivatives and the polymer are dissolved in a low boiling point solvent such as, for example, ethylacetate; the thus obtained solution is poured into a hydrophilic colloid; and the resulting mixture is emulsified with the use of an emulsifying dispersing machine such as, for example, a homogenizer.

A desired photosensitive material can be produced by coating and drying a silver halide emulsion or a dye providing compound emulsion containing the above-mentioned emulsion, on a support.

The amount of the hydroquinone derivatives used in the present invention, although it is not limited to, is suitable to be from about 0.01 to 0.1 millimol/$m^2$, preferably about 0.04 to 0.08 millimol/$m^2$. Further the amount of the polymer, although it is not limited to, is suitable to be from about 0.1 to 30 times, preferably, 6 to 12 times as large as the amount of the hydroquinone derivatives on a weight basis.

Gelatin is particularly effective as the hydrophilic colloid used in the present invention. However, any other hydrophilic colloids which can be used for photography such as polyvinylalcohol can be used.

Solvents having a low boiling point less than 100° C. is preferable as the solvent for dissolving the hydroquinone derivatives and the polymer. Ethylacetate, methylethylketone, etc. are more preferable since they can be easily removed in the drying step after the coating step.

The photosensitive materials according to the present invention can be suitably used in a color diffusion transfer process. However, they can also be used in a heat developable color photographic process, and so forth. The latter type photosensitive materials are detailed in, for example, Japanese Patent Application (OPI) No. 58543/83.

The light-sensitive silver halide emulsion used in the present invention is a hydrophilic colloid-like dispersion selected from the group consisting of silver chloride, silver bromide, silver chlorobromide, silver iodobromide, silver chloroiodobromide and the mixture thereof. The composition of halogen is selected in accordance with the purpose of use and the condition of processing. However, it is particularly preferable to use silver bromide, silver iodobromide or silver chloroiodobromide, containing therein less than 10 mol % iodide and less than 30 mol % chloride.

Even either negative type emulsions forming a surface latent image or direct reversal type emulsions can be used in the present invention. Internal latent image type emulsions and previously fogged direct-reversal type emulsions can be used as the latter emulsions.

In the case that the present invention is applied in the color diffusion transfer process, an internal latent image type direct-reversal silver halide emulsion can be advantageously used, and the emulsions of this type include conversion type emulsions, core/shell type emulsions, the emulsions containing metals of different kinds, or the like, which are described in, for example, U.S. Pat. Nos. 2,592,250, 3,206,313, 3,447,927, 3,761,276 and 3,935,014.

Typical nucleating agents for the emulsion of this type, are hydrazines disclosed in U.S. Pat. Nos. 2,588,982, and 2,563,785; hydrazides and hydrazones disclosed in U.S. Pat. No. 3,227,552; quaternary salt compounds disclosed in British Pat. No. 1,283,835; Japanese Patent Publication No. 38164/74 and U.S. Pat. Nos. 4,115,122, 3,734,738, 3,719,494 and 3,615,615; sensitizing dyes having nucleating substituent in dye molecules disclosed in U.S. Pat. No. 3,718,470; acylhydrazine series compounds of thiourea combination type disclosed in U.S. Pat. Nos. 4,030,925, 4,031,127, 4,245,037, 4,255,511, 4,266,013 and 4,276,364; urea type acylhydrazine series compounds disclosed in U.S. Pat. No. 4,374,923.

The dye providing compounds which can be used in the present invention include mobile dye releasing type redox compounds (which will be denoted hereinbelow as "DRR compounds"), couplers, dye developing agents, or the like, preferably, DRR compounds. In the case that the moving velocity of DRR compounds is relatively lower than that of released mobile dyes, the DRR compounds may be somewhat mobile.

In the case that the photosensitive material according to the present invention is used in the nonpeel-apart type color diffusion transfer process, the DRR compounds are immobile under the condition of alkali processing, and is preferably represented by the following formula (I):

(Ballast)—(Link)—(Dye) (I)

wherein (Ballast) is the ballast group for immobilizing the instant compounds under the alkali processing condition, (Dye) is the dye group or the precursor thereof which may be moved in a photographic layer at least under the condition of alkali processing, and (Link) is either the divalent group (positive type) which is subjected to cutting due to oxidation accompanied with development, or the redox cleavage group (positive type) which has such a property that the cutting is contrarily restrained.

The negative type Links are, for example, disclosed in U.S. Pat. Nos. 4,135,929, 4,053,312 and 4,336,322, and Japanese Patent Application (OPI) Nos. 33826/73, 104343/76, 46730/78, 130122/79, 113624/76, 12642/81, 161131/81, 4043/82, 650/82, 20735/82, 54021/79 and 71072/81. As specific examples of the negative type links, the hereinbelow explained N-substitution sulfamoyl groups can be used (an aryl group is preferable as the substituent), although the present invention is not limited thereto.

Further, examples of the (Ballast)—(Link)—which release mobile dyes include:

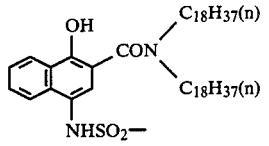

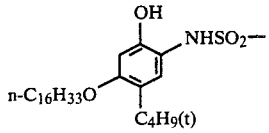

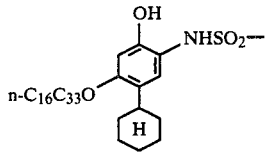

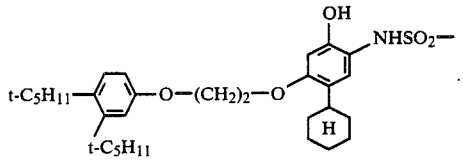

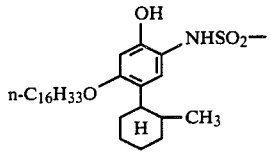

Meanwhile, the positive type Links are, for example, disclosed in U.S. Pat. Nos. 4,199,354, 4,199,355, 4,139,379, 4,139,389, 3,719,489 and 4,098,783; Japanese Patent Application (OPI) Nos. 111628/74, 63618/76, 69033/78, 130927/79, 164342/81 and 4319/77; and Japanese Patent Application (OPI) No. 185333/84. Although the present invention is not limited thereto the following materials, preferable specific examples of the positive type Links include:

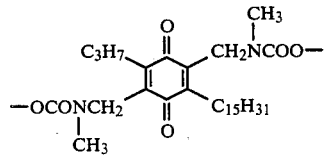

-continued

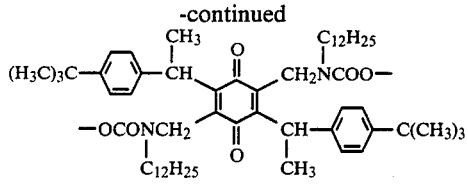

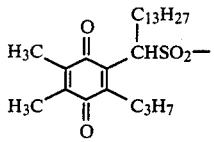

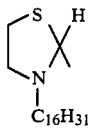

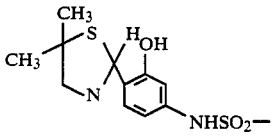

It is well-known that, of these positive type dye providing compounds, those of the type which is made possible to release dyes upon reduction, as those represented by quinone nuclei, are used in combination with nondiffusible type electron donative compounds (which are well-known as ED compounds) or the precursors thereof. The ED compounds are, for example, disclosed in U.S. Pat. Nos. 4,263,393 and 4,278,750; and Japanese Patent Application (OPI) No. 138736/81.

Further, the positive type DRR compounds may be those which release dyes by intramolecular oxidation-reduction reaction, and which are of the type that electron donative parts are incorporated within the molecules.

The dyes which are released form the DRR compounds may be either established dyes or the precursors of dyes which can be converted into dyes during a photographing processing step or an additional processing step, and which may or may not be of metal-chelation type in their final image dyes. Typical dyes of these are, azo dyes, azomethine dyes, anthraquinone dyes, phthalocyanine dyes, etc. which can be of either metal-chelation type or non-metal-chelation type. Of these dyes, the azo type cyan, magenta and yellow dyes are particularly useful.

Examples of Yellow Dye:

Yellow dyes can be those disclosed in U.S. Pat. Nos. 3,579,200, 3,309,199, 4,013,633, 4,245,028, 4,156,609, 4,139,383, 4,159,992, 4,148,641, 4,148,643 and 4,336,322; Japanese Patent Application (OPI) Nos. 114930/76 and 71072/81; and *Research Disclosure* Nos. 17630 (1978) and 16475 (1977).

Examples of Magenta Dyes:

Magenta dyes can be those disclosed in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292; and Japanese Patent Application (OPI) Nos. 106727/77, 23628/78, 36804/80, 73057/81, 71060/81 and 134/80.

Examples of Cyan Dyes:

Cyan dyes can be those disclosed in U.S. Pat. Nos. 3,482,972, 3,929,760, 4,013,635, 4,268,625, 4,171,220, 4,242,435, 4,142,891, 4,195,994, 4,147,544 and 4,148,642; British Pat. No. 1,551,138; Japanese Patent Application (OPI) Nos. 99431/79, 8827/77, 47823/78, 143323/78, 99431/79 and 71061/81; European Pat. Nos. (E. P. C.) 53,037 and 53,040; and *Research Disclosure* Nos. 17,630 (1978) and 16,475 (1977).

As one kind of the dye precursors, DRR compounds having such certain dye portions that light-absorption is temporarily shifted in photosensitive materials can be used in the present invention. Specific examples of them are disclosed in Japanese Patent Application (OPI) Nos. 53330/80 and 53329/80; U.S. Pat. Nos. 3,336,287, 3,579,334 and 3,982,946 and British Pat. No. 1,467,317.

The coating amount of DRR compounds is $1\times10^{-4}$ to $1\times10^{-2}$ mol/m$^2$, preferably $2\times10^{-4}$ to $2\times10^{-3}$ mol/m$^2$.

In order to reproduce natural colors by the subtractive color process there is used a photosensitive material composed of at least two combinations of silver halide emulsions having selective spectral sensitivities in a certain range of wavelengths and of DRR compounds having selective spectral absorptions in the same range of wavelengths or other ranges of wavelengths of the silver halide emulsions.

Particularly, in the case that the present invention is applied to the color diffusion transfer process, the photosensitive material composed of the combination of a blue-sensitive silver halide emulsion layer and a yellow DRR compound, the combination of a green-sensitive silver halide emulsion layer and a magenta DRR compound and the combination of a red-sensitive silver halide emulsion layer and a cyan DRR compound can be effectively used. The combination units of these silver halide emulsions and DRR compounds can be coated by stratifying them in a face-to-face relation and also can be formed into particles which are then mixed together and coated as one layer. Image receiving materials (including at least a mordant layer), neutralizing layers or neutralizing rate adjusting layers (timing layers), reflecting layers, light-shielding layers, cover sheets, etc., all of which can be used in the present invention, are, for example, disclosed in Japanese Patent Application (OPI) No. 64533/77.

Polymer mordants used in mordant layers are polymers having a molecular weight of more than 5,000, and preferably more than 10,000, such as, for example, polymers including secondary and tertiary amino groups, polymers having nitrogen-containing heterocyclic groups and polymers having quaternary cation groups.

In the case that the photosensitive material according to the present invention is used in the color diffusion transfer process, any silver halide developing agent can be used as those which are used for the color diffusion transfer process whenever oxidation product of the developing agent can subject a dye providing compound to cross-oxidation or couple with this compound. Color developing agents can also be used as the developing agent, but black-and-white developing agents such as, for example, 3-pyrazolidone groups are preferably used.

A preferred embodiment of the photosensitive materials of the present invention is hereafter explained. An image receiving layer, a light reflecting layer for substantially shielding light (a combination of, for example, a $TiO_2$ layer and a carbon black layer) and at least one silver halide light-sensitive layer which is accompanied with the DRR compounds are coated on a transparent support, and further, a transparent cover sheet is superposed thereon in a face-to-face relation. A container which stores therein alkaline processing solution containing a light-shielding agent (for example, carbon black) and which can be ruptured under pressure, is arranged, adjacently to the uppermost layer (protecting layer) of the above-mentioned light-sensitive layer and as well to the transparent cover sheet. Such a film unit is exposed through the transparent cover sheet, and the container is ruptured by a pressing member when the film unit is taken out from a camera so that the alkaline processing solution is overspread between the light-sensitive layer and the cover sheet. Thereby the light-sensitive layer is light-shielded in a sandwich-like form while development progresses in the light.

It is preferable to incorporate a neutralizing machanism in the photosensitive material according to the present invention. Particularly, it is more preferable that the neutralizing layer is provided to the cover sheet (further, the timing layer is laid, if desired, on the side where the processing solution is spread).

Further, in the photosensitive material in the above-mentioned embodiment of the present invention, the part including the image receiving layer (color print) may be peeled apart from the part including the light-sensitive layer or layers after completion of a transfer image. However, whether the peeling is made or not is dependent upon the user's preference.

In another embodiment of the present invention, there can be a film unit which is formed such that the processing solution is spread between an image receiving sheet having a mordant layer on a support, preferably including a neutralizing mechanism, and a light-sensitive sheet having the above-mentioned light-sensitive layer or layers and a dye providing compound-containing layer or layers on another support, including both, so-called, "peel-apart type" and "nonpeel-apart type".

The following examples are provided for illustrative purposes only and are in no way intended to limit the scope of the present invention.

EXAMPLE 1

A light-sensitive sheet for comparison is prepared by coating the following layers in the mentioned order on a polyethyleneterephthalate film support:

Light-Sensitive Sheet (A)

(1) A mordanting layer containing 3.0 g/m$^2$ copolymer [styrene-N-vinylbenzyl-N,N,N-trihexylammoniumchloride] and 3.0 g/m$^2$ gelatin;

(2) A light reflecting layer containing 20 g/m$^2$ titanium dioxide and 2.0 g/m$^2$ gelatin;

(3) A light shielding layer containing 3.0 g/m$^2$ carbon black and 2.0 g/m$^2$ gelatin;

(4) A layer containing 0.44 g/m$^2$ cyan dye releasing redox compound having the following chemical structure, 0.09 g/m$^2$ tricyclohexylphosphate and 0.8 g/m$^2$ gelatin;

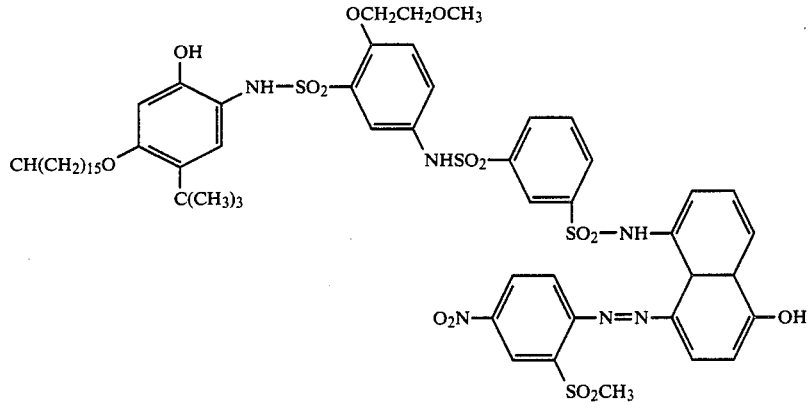

(5) A layer containing an internal latent image type red-sensitive direct-reversal silver bromide emulsion (containing 1.03 g/m$^2$ silver and 1.2 g/m$^2$ gelatin), 0.06 g/m$^2$ nucleating agent having the following chemical structure, and 0.07 g/m$^2$ 2-sulfo-5-n-pentadecylhydroquinone sodium salt,

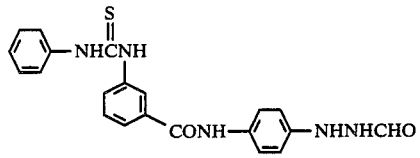

(6) An intermediate layer including color stain preventing agent, containing 0.8 g/m$^2$ gelatin, 1.0 g/m$^2$ 2,5-di-t-pentadecylhydroquinone and 1.0 g/m$^2$ polymethylmethacrylate;

(7) A layer containing 0.21 g/m$^2$ magenta dye releasing redox compound having the following chemical structure I, 0.11 g/m$^2$ magenta dye releasing redox compound having the following chemical structure II, 0.08 g/m$^2$ tricyclohexylphosphate and 1.8 g/m$^2$ gelatin;

Chemical Structure I:

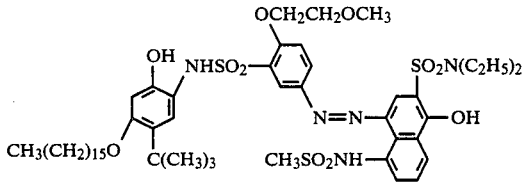

Chemical Structure II:

-continued

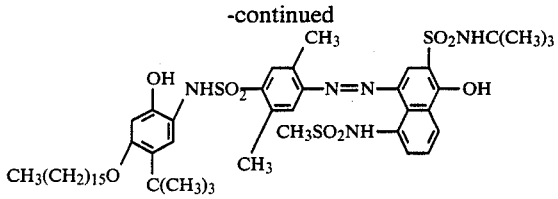

(8) A layer containing an internal latent image type green-sensitive direct-reversal silver bromide emulsion (containing 0.91 g/m$^2$ and 1.4 g/m$^2$ gelatin), 0.04 g/m$^2$ nucleating agent same as in the layer (5) and 0.05 g/m$^2$ 2-sulfo-5-n-pentadecylhydroquinone sodium salt;

(9) An intermediate layer including a color mixing preventing agent, containing 0.8 g/m$^2$ gelatin, 1.0 g/m$^2$ 2,5-di-t-pentadecylhydroquinone and 1.0 g/m$^2$ polymethylmethacrylate;

(10) A layer containing 0.02 g/m$^2$ yellow dye releasing redox compound having the following chemical structure, 0.16 g/m$^2$ tricyclohexylphosphate and 0.8 g/m$^2$ gelatin;

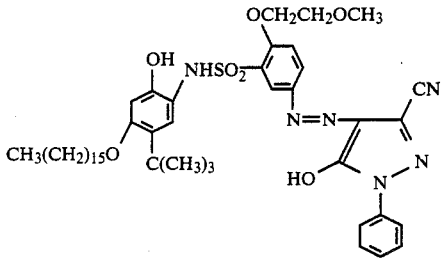

(11) A layer containing an internal latent image type blue-sensitive direct-reversal silver bromide emulsion (containing 1.09 g/m$^2$ silver and 1.1 g/m$^2$ gelatin), 0.04 mg/m$^2$ nucleating agent same as in the layer (5) and 0.06 g/m$^2$ 2-sulfo-5-n-pentadecylhydroquinone sodium salt;

(12) A layer containing 1.0 g/m$^2$ gelatin

Three kinds of gelatin emulsions having the following component ratios are prepared by the above-mentioned emulsifying dispersing method;

Emulsion (1): 2,5-di-t-pentadecylhydroquinone alone;

Emulsion (2): 2,5-di-t-pentadycylhydroquinone/-polyvinylacetate=1/12;

Emulsion (3): 2,5-di-t-pentadecylhydroquinone/-polymethylmethacrylate=1/12.

By adding the above-mentioned emulsions in desired layers in the light-sensitive sheet, the following light-sensitive sheets (B) through (G) are prepared.

Light-Sensitive Sheet (B)

The emulsion (1) is added to the layer (7) containing magenta dye releasing redox compound [same as the light-sensitive sheet (A), excepting that the emulsion (1) is added to the layer (7) of the light-sensitive sheet (A) so that the content of 2,5-di-t-pentadecylhydroquinone becomes 0.1 g/m$^2$ (coated material for comparison)].

Light-Sensitive Sheet (C)

The emulsion (2) is added to the layer (7) containing magenta dye releasing redox compound [same as the light-sensitive sheet (A), excepting 0.1 g/m$^2$ 2,5-di-t-pentadecylhydroquinone and 1.2 g/m$^2$ polyvinylacetate are added to the layer (7) of the light-sensitive sheet (A) (the present invention).

Light-Sensitive Sheet (D)

The emulsion (2) is added to the layer (4) containing cyan dye releasing redox compound [same as the light-sensitive sheet (A), excepting that 0.08 g/m$^2$ 2,5-di-t-pentadecylhydroquinone and 0.96 g/m$^2$ polyvinyl acetate are added to the layer (4) of the light-sensitive sheet (A) (the present invention)].

Light-Sensitive Sheet (E)

The emulsion (B) is added to the layer (10) containing yellow dye releasing redox compound [same as the light-sensitive sheet (A), excepting that 0.06 g/m$^2$ 2,5-di-t-pentadecylhydroquinone and 0.72 g/m$^2$ polyvinylacetate are added to the layer (10) of the light-sensitive sheet (A) (the present invention)].

Light-Sensitive Sheet (F)

The emulsion (2) is added to the green-sensitive emulsion layer (8) [same as the light-sensitive sheet (A), excepting that 0.05 g/m$^2$ 2,5-di-t-pentadecylhydroquinone and 0.6 g/m$^2$ polyvinylacetate are added to the layer (8) of the light-sensitive sheet (A) (the present invention)].

Light-Sensitive Sheet (G)

The emulsion (3) is added to the green-sensitive emulsion layer (8) [same as the light-sensitive sheet (A), excepting that 0.05 g/m$^2$ 2,5-di-t-pentadecylhydroquinone and 0.6 g/m$^2$ polymethylmethacrylate are added to the layer (8) of the light-sensitive sheet (A) (the present invention)].

Coating Process of Cover Sheet

The following layers (1') through (3') are coated in this order to a transparent polyester support:

(1') A layer containing 22 g/m$^2$ copolymer of acrylic acid and acrylic acid butyl (weight ratio of 80 to 20) and 0.44 g/m$^2$ 1,4-bis(2,3-epoxypropoxy)butane;

(2') A layer containing 3.8 g/m$^2$ acetylcellulose (100 g acetylcellulose is hydrolized so as to form 39.4 g acetyl group), 0.2 g/m$^2$ (molecular weight of about 50,000) copolymer of stylene and maleic anhydride (weight ratio of 60 to 40) and 0.115 g/m$^2$ 5-($\beta$-cyanoethylthio)-1-phenyltetrasol;

(3') A layer containing 2.5 g/m$^2$ copolymer latex of vinylidene chloride, methylacrylate and acrylic acid (weight ratio of 85 to 12 to 3) and 0.05 g/m$^2$ latex of polymethyl methacrylate (particle size of 1 to 3 $\mu$m).

| Formulae of Processing Solution | |
|---|---|
| 1-p-tryl-4-hydroxymethyl-4-methyl-3-pyrozolidinone | 12 g |
| Methylhydroquinone | 0.3 g |
| 5-methylbenzothriazol | 3.5 g |
| Sodium sulfite (anhydrous) | 0.2 g |
| Carboxymethylcellulose sodium salt | 43 g |
| Potassium hydroxide | 56 g |
| Benzyl alcohol | 1.5 ml |
| Carbon black | 150 g |
| Water amount making the total weight to be | 1 kg |

The above-mentioned light-sensitive sheets (A) through (G) are imagewise exposed, from their light-sensitive layer sides, to light which is obtained by converting 2854° K. tungsten light into 4800° K. through a Davis-Gibson filter and which is passed through a continuous wedge (maximum exposure is 10CMS at this time).

The thus exposed light-sensitive sheets are united with containers containing the above-mentioned processing solution and as well cover sheets, and then the containers are ruptured under the respective conditions of 10° C., 25° C. and 35° C. so as to spread the processing solution.

One day after, the transferred dye densities are measured with the use of a color densitometer. The results are denoted in the following Table.

From the results indicated in the Table, it is found that, using the emulsions according to the present invention, the difference Δ log E between the cases that the added objective layers are processed at temperatures of 15° C. and 35° C., respectively, is remarkably decreased without giving substantially no effect in photographic properties for any layers other than the added objective layers. That is the temperature latitude can be widened.

TABLE

| | | Δ log E (Difference between Values at 15° C. and 35° C.)*1 | | |
|---|---|---|---|---|
| | | B*2 | G*2 | R*2 |
| For Comparison | A | −0.19 | −0.32 | −0.24 |
| For Comparison | B | −0.19 | −0.30 | −0.23 |
| Present Invention | C | −0.19 | −0.10 | −0.23 |
| Present Invention | D | −0.19 | −0.31 | −0.11 |
| Present Invention | E | −0.09 | −0.30 | −0.25 |
| Present Invention | F | −0.20 | −0.11 | −0.24 |
| Present Invention | G | −0.19 | −0.15 | −0.23 |

*1Value obtained by subtracting value at 35° C. from value at 15° C.
*2Measuring is made at a density or 0.70 point While the invention has been described in detail and with reference to specific embodiments thereof, it will be apparent to one skilled in the art that various changes and modification can be made therein wlthout departing from the spirit and scope thereof.

What is claimed is:

1. A photosensitive material comprising a support having thereon at least one silver halide emulsion layer or layers associated with a dye-providing compound capable of forming an imagewise mobile dye as the result of exposure and development, wherein a hydroquinone derivative and a water-insoluble but organic solvent-soluble homopolymer or copolymer having a recurring unit containing a

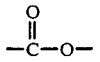

bond in a main chain or side chain are integrated and dispersed as individual particles in a hydrophilic colloid of the at least one silver halide emulsion layer or layers, wherein said hydroquinone derivatives are selected from the group consisting of a mixture of hydroquinone compounds wherein two tertiary alkyl groups having 15 carbon atoms are substituted at the 2- and 5-, or the 2- and 6-positions of the benzene ring, and an isomer mixture of secondary dodecyl hydroquinone compounds.

2. The photosensitive material as claimed in claim 1, wherein said polymers are selected from the group consisting of homopolymers and copolymers each having the recurring unit shown by each of the following formulae:

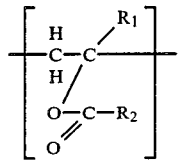

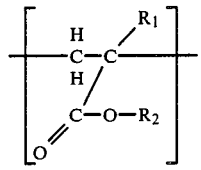

wherein $R_1$ represents hydrogen atom or an unsubstituted or substituted alkyl group and $R_2$ represents an unsubstituted or substituted alkyl group or an unsubstituted or substituted aryl group; polyester resins obtained by the condensation of polyhydric alcohols and polybasic acids; and polyesters having the recurring unit shown by the following formulae:

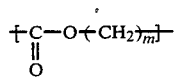

wherein m represents an integer of 4 to 7 and the chain —$CH_2$— may be a branched one.

3. The photosensitive material as claimed in claim 2, wherein said polymer is selected from the group consisting of polyvinyl acetate, polyvinyl propionate, vinyl acetate-vinyl alcohol copolymer, polymethyl methacrylate, polyethyl acrylate, polyethylmethacrylate, polybutylacrylate, polybutylmethacrylate, polyisobutylmethacrylate, polyisopropylmethacrylate, polyoctylacrylate, butylacrylate-acrylamido copolymer, stearylmethacrylateacrylic acid copolymer, 1,4-butandiol-adipic acid polyester, ethyleneglycol-sebasic acid, polycaprolactone, polypropiolactone and polydimethylpropiolactone.

4. The photosensitive material as claimed in claim 1, wherein said hydroquinone derivatives are those which have a solidifying point less than 100° C.

5. The photosensitive material as claimed in claim 1, wherein said hydroquinone derivatives are employed in an amount of from 0.01 to 0.1 millimol/$m^2$.

6. The photosensitive material as claimed in claim 1, wherein said polymer is employed in an amount of from 0.1 to 30 times as large as the amount of the hydroquinone derivatives on a weight basis.

7. The photosensitive material as claimed in claim 6, wherein said polymer is employed in an amount of from 6 to 12 times as large as the amount of the hydroquinone derivatives on a weight basis.

8. The photosensitive material as claimed in claim 1, wherein said hydrophilic colloid is gelatin.

* * * * *